US006558484B1

(12) United States Patent
Onoe et al.

(10) Patent No.: US 6,558,484 B1
(45) Date of Patent: May 6, 2003

(54) HIGH STRENGTH SCREW

(75) Inventors: Hiroshi Onoe, 13-22, Oimazatominami 4-chome, Higashinari-ku, Osaka-shi, Osaka 537-0013 (JP); Tetsuo Shiraga, Tokyo (JP); Katsuhiko Kikuchi, Tokyo (JP)

(73) Assignee: Hiroshi Onoe, Osaka (JP)

( * ) Notice: Subject to any disclaimer, the term of this patent is extended or adjusted under 35 U.S.C. 154(b) by 0 days.

(21) Appl. No.: 10/086,728

(22) Filed: Mar. 4, 2002

(51) Int. Cl.[7] ..... C22C 38/18; C22C 38/26; C22C 38/28; C22C 38/40; C22C 38/20

(52) U.S. Cl. ..... 148/333; 148/334; 148/335

(58) Field of Search ..... 148/333, 334, 148/335; 420/104, 105, 108, 109, 110

(56) References Cited

FOREIGN PATENT DOCUMENTS

| | | | | |
|---|---|---|---|---|
| JP | 5-93244 | * | 4/1993 | ..... C22C/38/12 |
| JP | 9-67625 | | 3/1997 | |
| JP | 10-196627 | | 7/1998 | |

* cited by examiner

*Primary Examiner*—Deborah Yee
(74) *Attorney, Agent, or Firm*—Armstrong, Westerman & Hattori, LLP

(57) ABSTRACT

To provide a high-strength steel having a desired strength (800 N/mm$^2$ or higher) for screws and bolts of a large diameter (M8 or larger) that also have a tapping ability, and a high-strength screw made from such a steel. The steel comprises (by % mass) C: 0.05 to 0.20, Si: 0.20 or less (not including 0), Mn: 0.5 to 2.0, P: 0.015 or less, S: 0.015 or less, sol. Al: 0.020 to 0.080, N: 0.0060 or less, Cr: more than 0.80 to 2.0 and the balance being iron and unavoidable impurities.

6 Claims, No Drawings

HIGH STRENGTH SCREW

BACKGROUND OF THE INVENTION

1. Field of the Invention

The present invention relates to a steel for the manufacture of high-strength screws and to a high-strength screw made from said steel. More specifically, the present invention relates: to a steel for the manufacture of high-strength screws having a tapping ability for joining a member (in which a prepared hole has been formed) whilst forming a large diameter (M8 or larger) internal thread and having a strength of 800 N/mm$^2$ or more; and to a high-strength screw made from such a steel.

2. Description of the Prior Art

A tapping screw joins members together through forming an internal thread through the members. This can only be achieved if a prepared hole is formed in the members that are to be joined together. In order to be able to use tapping screws to join members together by forming an internal thread the tapping screws must be harder than the members. The tapping screw must be sufficiently harder than the members to be joined in order to cut the thread in the members. This is also important for the joint to be mechanically sound.

For these reasons, a conventional screw, for example, a cross-recessed tapping screw (in accordance with JIS B1122) has been manufactured from carbon-steel wires of SWRCH 12A to 22A (aluminum killed steel) or from SWRCH 12K to 22K (killed steel) (in accordance with JIS G3539) through the processes of forming a screw through rolling the steel, and refining the formed screw by using the techniques of cementation, hardening, and tempering.

One important factor of steel for use in the manufacture of tapping screws is its' toughness after hardening, therefore aluminum killed steels are used as they have fine crystal grains. However, properties that conflict with toughness (such as hardness and strength) must also reach satisfactory levels as well. Japanese Patent Laid Open No. 9-67625 discloses a tapping screw manufactured from a steel that has a high-magnesium (Mn) content and a low carbon (C) content by a process of cementation, hardening and tempering, that has a surface hardness Hv of 560 to 600 and an internal hardness Hv of 320 to 360. Hereafter, this type of tapping screw is referred to as prior art 1.

Japanese Patent Laid Open No. 10-196627 (1998) discloses a screw manufactured from a low carbon-high Mn steel that has a surface hardness Hv of 550 or higher and an internal hardness Hv of 320 to 400. Hereafter, this type of tapping screw is referred to as prior art 2.

In order to be able to join high strength members, an even higher surface hardness and internal toughness is required in the screw in order to be able to form an internal thread in the members. At present however, the materials and the method for manufacturing such a screw have not been established.

Both prior art 1 and prior art 2 are intended to be used for the manufacture of relatively small diameter screws (for example, smaller than M6). Therefore, if screws or bolts of M8 or larger are manufactured from these materials it is difficult to obtain the well-balanced surface hardness and internal hardness (after cementation) and the required strength.

The object of the present invention is to provide a steel for use in the manufacture of high-strength tapping screws (having a strength of 800 N/mm$^2$ or higher) and for tapping screws or bolts of large diameters (M8 or larger) and also to provide a high-strength screw manufactured from such a steel.

SUMMARY OF THE INVENTION

The inventors of the present invention conducted intensive studies in order to solve the above-described problems and obtained the following findings.

The hardness balance of screws and bolts of large diameters after cementation can be controlled and the desired strength can be obtained by:

(1) the addition of a large quantity of Cr, (2) the adjustment of the ingredients to the adequate DI-value range, (3) the adequate control of the surface hardness internal hardness and effective depth of the hardened layer, and (4) the adequate control of the tempering temperature after cementation hardening.

The present invention is based on such findings and is characterized by the following;

The invention is characterized by a steel for high-strength screws comprising(by % mass): C: 0.05 to 0.20, Si: 0.20 or less (not including 0), Mn: 0.5 to 2.0, P: 0.015 or less, S: 0.015 sol. Al: 0.020 to 0.080, N: 0.0060 or less, Cr: more than 0.80 to 2.0 and the balance being iron and unavoidable impurities.

The invention is also characterized by the steel for high-strength screws further comprising (by % mass) of at least one selected from a group consisting of: Ni: 3.5 or less, Cu: 1.0 or less, Mo: 0.30 or less, and B: 0.0005 to 0.0050: and at least one selected from a group consisting of: Ti: 0.005 to 0.050 and Nb: 0.005 to 0.050.

The invention is also characterized by the steel for high-strength screws wherein the DI value represented by the following equation (1) is within a range of between 17 mm and 43 mm.

The invention is also characterized by the steel for high-strength screws wherein the DI value represented by the above equation (1) is within a range between 17 mm and 43 mm.

The invention is also characterized by a high-strength screw wherein the surface hardness Hv after cementation is 550 to 700, the internal hardness Hv after cementation is 200 to 320, the effective depth of the hardened layer is 0.05 to 1.00 mm and the strength of 800 N/mm$^2$ or more.

The invention is also characterized by a high-strength screw wherein the surface hardness Hv after cementation is 550 to 700, the internal hardness Hv after cementation is 200 to 320, the effective depth of the hardened layer is 0.05 to 1.00 mm and the strength of 800 N/mm$^2$ or more.

The invention is also characterized by a high-strength screw wherein the surface hardness Hv after cementation is 550 to 700, the internal hardness Hv after cementation is 200 to 320, the effective depth of the hardened layer is 0.05 to 1.00 mm and the strength of 800 N/mm$^2$ or more.

The invention is also characterized by a high-strength screw wherein the surface hardness Hv after cementation is 550 to 700, the internal hardness Hv after cementation is 200 to 320, the effective depth of the hardened layer is 0.05 to 1.00 mm and the strength of 800 N/mm$^2$ or more.

The invention is also characterized by the high-strength screw wherein tempering is carried out within a temperature range between 200° C. and 400° C. after cementation.

The invention is also characterized by the high-strength screw wherein tempering is carried out within a temperature range between 200° C. and 400° C. after cementation.

DESCRIPTION OF THE PREFERRED EMBODIMENT

The reason for limiting the values in the present invention will be described below.

(1) C: 0.05 to 0.20% by mass

"C" is an important element in the manufacture of strong steel. If the content of C is less than 0.05% by mass high strength cannot be obtained and cementation-hardenability lowers. If the content of C exceeds 0.20% by mass the internal hardness of the screw becomes too high and the toughness of the steel lowers. Therefore, the content of C was limited to the range between 0.05 and 0.20% by mass.

(2) "Si": 0.20% by mass or less (not including 0)

Since Si plays an important role as a deoxidizing agent it is always added to steel in the manufacturing process. It also improves the resistance of the steel to softening (due to tempering and hardenability) and increases the strength of the steel. If the content of Si is too high the resistance to deformation increases and therefore the ability to cold-forge the steel is lowered. The upper limit of the Si content was determined to be 0.20% by mass.

(3) Mn: 0.5 to 2.0% by mass

Similarly to Si, Mn is an element required in the deoxidizing process of steel. It also increases the hardenability of steel. The addition of at least 0.5% Mn by mass is necessary for the steel to reach the required strength. Since Mn (as does P and S) separates on the crystal grain boundary of steel (and therefore increases the brittlement at the grain boundary) the upper limit of the Mn content was determined to be 2.0% by mass.

(4) P: 0.015% by mass or less

P separates on the austenite grain boundary and therefore weakens the boundary and it also dissolves in ferrite to form a solid solution and lowers the deformability of the steel. Since P is an impurity in the present invention the content of P was determined to be 0.015% by mass or less.

(5) S: 0.015% by mass or less

S forms MnS to lower the deformability of the steel and MnS can also become the point from which cracks propagate. Since S is an impurity in the present invention the content of S was determined to be 0.015% by mass or less.

(6) Sol. Al: 0.020 to 0.080% by mass

Al is not only a deoxidizing agent, but also stops N from separating on the grain boundary (fixing it as AlN) and therefore improves the strength of the grain boundary. In order to have this effect on N, the content of Al is 0.020% by mass or higher as sol. Al (acid-soluble Al). However, if the sol. Al content exceeds 0.080% by mass, the aggregate of $Al_2O_3$ is formed during the continuous casting of ingots causing the nozzle to be choked and making the casting operation difficult. Therefore, the required content of sol. Al was determined to be within a range of between 0.020 and 0.080% by mass.

(7) N: 0.0060% by mass or less

N causes strain-aging hardening during screw processing to lower the cold-forgeability of steel and also shortens the life of the tools. Since N is an impurity in the present invention the content of N was determined to be 0.0060% by mass or less.

(8) Ti: 0.005 to 0.050% by mass

Ti has the ability to refine crystal grains. If the level of Ti is less than 0.005% by mass the refining effect is small, also the effect to fix N as TiN is also small. However, the addition of Ti in excess of 0.050% by mass not only saturates these effects but also forms large quantities of hard TiN and TiC, lowering forgeability and raising the cost of alloying. The content of Ti was determined to be within a range between 0.005 and 0.050% by mass.

(9) Cr: more than 0.80 to 2.0% by mass

Cr raises the hardenability of steel and also ensures its' strength. Studies have shown that the addition of Cr in excess of 0.80% by mass is required to ensure the strength of large bolts of M8 or larger. However, since Cr also raises the resistance of the steel to softening due to tempering, the excessive addition of Cr will make the steel too hard, and adversely affects the toughness of the steel. Therefore, the upper limit of the content of Cr was determined to be 2.0% by mass.

(10) Mo: 0.30% by mass or less

Mo is used to prevent the separation of P on a grain boundary, raise the strength of the grain boundary and to improve the hardenability of steel. However, since the excessive addition of Mo inhibits the cold-forgeability of steel (like Cr) and also Mo is an expensive element, the upper limit of Mo was determined to be 0.30% by mass.

(11) B: 0.0005 to 0.0050% by mass

The addition of a trace of B has the ability to improve the hardenability of steel. Also, B forms BN to prevent the separation of N on a grain boundary. The addition of B can lower the amount of Mn, Cr and Mo and further improve the cold-forgeability of steel. In order to make B exert such effects 0.0005% by mass or more B must be added. However, if more than 0.0050% by mass is added boron cementite is precipitated and the grain boundary strength is weakened. The content of B was therefore determined to be within a range of between 0.0005 and 0.0050% by mass.

(12) Nb: 0.005 to 0.050% by mass

Similarly to Ti, Nb has the ability to refine crystal grains. However, since the addition of less than 0.005% by mass of Nb has little effect, the lower limit was determined to be 0.005% by mass. However, (similar to Ti) since Nb has a strong affinity to C and N, it forms carbide or nitride easily and if Nb is added in a large quantity it is deposited on the grain boundary and accelerates brittleness as well as increasing the alloying costs. Therefore, the upper limit of the content of Nb was determined to be 0.050% by mass.

(13) Ni: 3.5% by mass or less

Ni imparts hardenability to steel and raises the static strength of steel. In addition, since Ni improves toughness it is useful to improve the hardenability and the toughness of the steel. However, if it is added excessively the effect becomes saturated and since it is a very expensive element, the upper limit of the content of Ni was determined to be 3.5% by mass.

(14) Cu: 1.0% by mass or less

Cu is also used to improve the hardenability and to raise the static strength of steel. The addition of Cu in an adequate quantity is effective to improve the mechanical properties of steel, although since the addition of too much Cu causes surface defects during hot rolling and causes defective cold forging, the upper limit of Cu was determined to be 1.0% by mass.

(15) Surface Vickers hardness Hv: 550 to 700

This range is required to obtain the required bolt strength and to form an internal thread in the members to be joined. If the Vickers hardness Hv is lower than 550 the tip of the tapping screw cracks or breaks and therefore cannot form the internal thread. If the Hv exceeds 700 the notch effect is raised and the occurrence of cracks will be accelerated. Therefore, the surface hardness Hv of the screw was determined to be within a range between 550 and 700.

(16) Internal Vickers hardness Hv: 200 to 320

Similarly to surface hardness, internal hardness is important to obtain the required bolt strength. If the internal hardness Hv is lower than 200 the required bolt strength is unobtainable. If the Hv exceeds 320 the toughness lowers and cracks can easily occur. Therefore, the internal hardness Hv of the screw was determined to be within a range between 200 and 320.

(17) Tempering temperature: 200 to 400° C.

The tempering temperature is directly related to the final performance (surface and internal hardness) of the bolt. If the tempering temperature is lower than 200° C. the steel becomes excessively hard, whilst if the tempering temperature exceeds 400° C. the steel will not attain the required. Therefore, the tempering temperature was determined to be within a range between 200° C. and 400° C.

(18) Effective depth of hardened layer: 0.05 to 1.00 mm

In order to be able to form an internal thread in the members that are to be joined a level of hardness is required in the surface of the screw. If the effective depth of the hardened layer is less than 0.05 mm the screws ability to form the internal thread is compromised; whilst if the effective depth exceeds 1.00 mm the internal toughness of the screw is lowered, which will increase the chance of cracks forming. Therefore, the effective depth of the hardened layer was determined to be within a range between 0.05 and 1.00 mm.

(19) DI value (mm): 17 to 43

The DI value (mm) is an index to evaluate the hardenability of steel and is calculated using the following equation (1). If the DI value of the steel is less than 17 mm the steel will not attain the required strength for use as a tapping screw; whilst if the DI value exceeds 43 mm there is a possibility that the toughness of the steel will be reduced. Therefore, the DI value was determined to be within a range between 17 and 43.

$$DI=25.4\times DIC(*1)\times FSi(*2)\times FMn(*3)\times FCr(*4)\times(FMo(*5), FCu(*6), FNi(*7), FB(*8)) \quad (1)$$

where:

*1: DIC=0.54×(C),

*2: FSi=1.00+0.7×(Si),

*3: FMn=3.3333×(Mn)+1.00 (Mn≦1.20), FMn=5.10×(Mn)−1.12 (Mn>1.20),

*4: FCr=1.00+2.16×(Cr),

*5: FMo=1.00+3.00×(Mo),

*6: FCu=1.00+0.365×(Cu),

*7: FNi=1.00+0.363×(Ni), and

*8: FB=2 (only when B is added).

EXAMPLES

The present invention will be described in further detail below with reference to the examples.

Steel materials containing the chemical components as shown in Table 1 were melted in a vacuum furnace of 150 kg/ch, then forged into billets of 116 mm square and hot-rolled into wires with a diameter of 8 mm. After cold forging and thread rolling, the materials were subjected to cementation hardening and tempering to form M8 tapping bolts Nos. 1 to 30. The bolts were manufactured as cross-headed countersunk bolts with a hexagonal collared head, of a nominal diameter of 8 mm and a nominal length of 30 mm.

TABLE 1

| No. | Classification | C | Si | Mn | P | S | sol. Al | N | Cr | Cu | Ni | Mo | Ti | Nb | B |
|---|---|---|---|---|---|---|---|---|---|---|---|---|---|---|---|
| 1 | Inventive example | 0.11 | 0.07 | 1.14 | 0.011 | 0.005 | 0.027 | 0.0052 | 0.82 | | | | | | |
| 2 | Inventive example | 0.13 | 0.08 | 1.15 | 0.011 | 0.005 | 0.027 | 0.0053 | 0.81 | | | | 0.030 | | |
| 3 | Inventive example | 0.10 | 0.10 | 1.75 | 0.012 | 0.012 | 0.025 | 0.0049 | 0.83 | | | | | | |
| 4 | Inventive example | 0.11 | 0.10 | 1.08 | 0.012 | 0.005 | 0.023 | 0.0057 | 0.85 | | | | | | |
| 5 | Inventive example | 0.10 | 0.11 | 1.12 | 0.011 | 0.008 | 0.025 | 0.0053 | 1.35 | | | 0.15 | | | |
| 6 | Inventive example | 0.09 | 0.12 | 1.15 | 0.011 | 0.006 | 0.023 | 0.0055 | 1.00 | | | | 0.035 | | 0.0035 |
| 7 | Inventive example | 0.13 | 0.14 | 1.08 | 0.012 | 0.009 | 0.028 | 0.0051 | 0.95 | | 0.14 | | | 0.015 | |
| 8 | Inventive example | 0.10 | 0.11 | 1.13 | 0.012 | 0.005 | 0.024 | 0.0053 | 0.82 | | | | | 0.034 | |
| 9 | Inventive example | 0.11 | 0.14 | 0.80 | 0.011 | 0.006 | 0.025 | 0.0055 | 0.81 | 0.25 | | 0.10 | 0.023 | | |
| 10 | Inventive example | 0.09 | 0.15 | 1.25 | 0.012 | 0.010 | 0.026 | 0.0054 | 0.97 | 0.15 | 0.07 | | | | |
| 11 | Inventive example | 0.12 | 0.13 | 0.90 | 0.012 | 0.007 | 0.028 | 0.0054 | 0.81 | | 0.10 | | 0.020 | | |
| 12 | Inventive example | 0.15 | 0.11 | 0.89 | 0.013 | 0.009 | 0.0030 | 0.0059 | 0.95 | 0.10 | | | | | |
| 13 | Inventive example | 0.13 | 0.09 | 0.95 | 0.013 | 0.009 | 0.270 | 0.0054 | 0.87 | | | | | | |
| 14 | Comparative example | 0.21 | 0.15 | 1.20 | 0.012 | 0.004 | 0.030 | 0.006 | 0.85 | | | | | | |
| 15 | Comparative example | 0.03 | 0.20 | 1.95 | 0.010 | 0.080 | 0.025 | 0.0055 | 1.00 | 0.15 | | | | | |
| 16 | Comparative example | 0.17 | 0.30 | 1.31 | 0.011 | 0.005 | 0.025 | 0.0051 | 0.87 | | | | | | |
| 17 | Comparative example | 0.11 | 0.15 | 2.10 | 0.009 | 0.005 | 0.026 | 0.0055 | 0.85 | | | | | | |
| 18 | Comparative example | 0.12 | 0.07 | 0.37 | 0.010 | 0.006 | 0.027 | 0.0058 | 0.90 | | | | | | |
| 19 | Comparative example | 0.12 | 0.08 | 1.20 | 0.020 | 0.005 | 0.027 | 0.0054 | 0.82 | | | | | | |
| 20 | Comparative example | 0.08 | 0.06 | 1.14 | 0.011 | 0.018 | 0.027 | 0.0052 | 0.81 | | | | | | |
| 21 | Comparative example | 0.14 | 0.09 | 1.13 | 0.009 | 0.004 | 0.005 | 0.0055 | 0.87 | | | | | | |
| 22 | Comparative example | 0.11 | 0.07 | 1.18 | 0.012 | 0.006 | 0.026 | 0.0078 | 0.82 | | | | | | |
| 23 | Comparative example | 0.10 | 0.07 | 1.18 | 0.010 | 0.008 | 0.028 | 0.0058 | 0.85 | | | | 0.055 | | 0.0088 |
| 24 | Comparative example | 0.12 | 0.09 | 1.20 | 0.009 | 0.007 | 0.025 | 0.0059 | 0.90 | | 0.15 | | | 0.060 | 0.0025 |
| 25 | Comparative example | 0.13 | 0.09 | 0.85 | 0.009 | 0.004 | 0.023 | 0.0055 | 2.60 | | | | | | |
| 26 | Comparative example | 0.10 | 0.09 | 1.05 | 0.010 | 0.005 | 0.023 | 0.0057 | 0.67 | | | | | | |
| 27 | Comparative example | 0.09 | 0.11 | 0.88 | 0.010 | 0.006 | 0.020 | 0.0055 | 0.81 | | | 0.40 | | | |
| 28 | Comparative example | 0.09 | 0.12 | 1.15 | 0.011 | 0.014 | 0.027 | 0.0052 | 0.85 | | | | | | |
| 29 | Comparative example | 0.13 | 0.06 | 1.14 | 0.011 | 0.012 | 0.027 | 0.0052 | 0.88 | | | | | | |
| 30 | Comparative example | 0.10 | 0.06 | 1.07 | 0.012 | 0.012 | 0.027 | 0.0051 | 0.83 | | | | | | |

Each of the tapping bolts manufactured was subjected to a tensile test and a head toughness test. The hardness, the effective depth of the hardened layer and the tapping ability of the bolt were evaluated from the results.

The tensile tests performed on the bolts were conducted using a wedge tensile tester in accordance with JIS B1051, with a wedge angle of 10° and the head toughness tests performed on the bolts were conducted in accordance with JIS B1055.

Surface hardness was measured at 0.02 mm below the surface layer; and internal hardness was measured at the D/4 location. The effective depth of the hardened layer was evaluated as the depth from the surface layer to the location of a hardness of Hv 550. All hardness measurements were undertaken using a micro-Vickers hardness meter.

The tapping ability of each bolt was evaluated by clamping the bolt (at a constant torque) into a prepared hole in a member and then ascertaining: the presence of any breaking, the state of the thread (was it broken or not?) and the presence of any cracks at the bottom of the thread (n=10).

The results of the above-described tests are shown in Table 2. In Table 2 the symbol "○" in the column of "Tapping ability" shows that at least 8 of bolts were not broken, damaged, or cracked. An "x" shows that 7 or less bolts were not broken, damaged or cracked.

TABLE 2

| No. | Classification | DI (mm) | Tempering temperature (° C.) | Tensile strength (N/mm$^2$) | Head toughness test | Effective depth of hardened layer (mm) | Surface hardness - Hv | Internal hardness - Hv | Tapping ability |
|---|---|---|---|---|---|---|---|---|---|
| 1 | Inventive example | 21.05 | 360 | 809 | Good | 0.16 | 575 | 252 | ○ |
| 2 | Inventive example | 25.02 | " | 812 | Good | 0.20 | 576 | 279 | ○ |
| 3 | Inventive example | 31.99 | " | 950 | Good | 0.31 | 623 | 300 | ○ |
| 4 | Inventive example | 21.06 | " | 828 | Good | 0.28 | 601 | 289 | ○ |
| 5 | Inventive example | 39.70 | " | 956 | Good | 0.26 | 670 | 317 | ○ |
| 6 | Inventive example | 40.88 | " | 810 | Good | 0.18 | 580 | 254 | ○ |
| 7 | Inventive example | 28.88 | " | 915 | Good | 0.25 | 601 | 298 | ○ |
| 8 | Inventive example | 19.51 | " | 823 | Good | 0.19 | 580 | 264 | ○ |
| 9 | Inventive example | 23.69 | " | 835 | Good | 0.27 | 603 | 279 | ○ |
| 10 | Inventive example | 24.00 | " | 856 | Good | 0.27 | 598 | 287 | ○ |
| 11 | Inventive example | 20.47 | " | 897 | Good | 0.29 | 607 | 301 | ○ |
| 12 | Inventive example | 27.80 | " | 903 | Good | 0.31 | 619 | 300 | ○ |
| 13 | Inventive example | 22.74 | 250 | 983 | Good | 0.30 | 701 | 375 | ○ |
| 14 | Comparative example | 45.13 | " | 1201 | Head broken | 0.37 | 781 | 410 | X |
| 15 | Comparative example | 13.80 | " | 650 | Good | 0.09 | 535 | 197 | X |
| 16 | Comparative example | 46.17 | " | 950 | Crack under neck | 0.23 | 609 | 400 | X |
| 17 | Comparative example | 45.34 | " | 1178 | Head broken | 0.40 | 760 | 410 | X |
| 18 | Comparative example | 11.35 | " | 638 | Good | 0.13 | 490 | 190 | X |
| 19 | Comparative example | 24.08 | " | 809 | Head broken | 0.22 | 640 | 253 | X |
| 20 | Comparative example | 15.09 | " | 801 | " | 0.19 | 630 | 247 | X |
| 21 | Comparative example | 28.01 | " | 835 | Head broken | 0.20 | 697 | 369 | X |
| 22 | Comparative example | 21.64 | " | 810 | Crack under neck | 0.22 | 565 | 322 | X |
| 23 | Comparative example | 40.26 | " | 838 | Crack under neck | 0.21 | 670 | 405 | X |
| 24 | Comparative example | 54.31 | " | 850 | " | 0.25 | 631 | 347 | X |
| 25 | Comparative example | 46.50 | " | 869 | " | 0.27 | 659 | 410 | X |
| 26 | Comparative example | 16.06 | " | 789 | " | 0.33 | 645 | 200 | X |
| 27 | Comparative example | 31.63 | " | 958 | " | 0.33 | 692 | 425 | X |
| 28 | Comparative example | 18.34 | 180 | 1128 | Head broken | 0.43 | 761 | 410 | X |
| 29 | Comparative example | 25.87 | 430 | 689 | Good | 0.17 | 537 | 200 | X |
| 30 | Comparative example | 18.23 | 360 | 709 | Good | 0.04 | 665 | 189 | X |

As Table 2 shows, Examples Nos. 1 to 13 are the bolts manufactured using the steel of the present invention, all the bolts excel in cold forgeability, tapping ability, required strength and toughness.

No. 14 is a comparison bolt, consisting of a steel whose C content and DI value are higher than that of the steel disclosed in the present invention. Bolt No. 14 had a high surface hardness and a high internal hardness, however, the bolt failed the head toughness test due to the head of the bolt breaking during the test.

No. 15 is a comparison bolt consisting of a steel whose C content and DI value are lower than the ranges disclosed in the present invention. Although bolt No. 15 performed satisfactorily in the head toughness test, neither the desired strength, surface hardness, or internal hardness were obtained and therefore the internal thread could not be formed and therefore this bolt had a poor tapping ability.

No. 16 is a comparison bolt consisting of a steel whose Si content and DI value are higher than the ranges disclosed within the present invention. Although bolt No. 16 had a high strength, it also had an increased resistance to deformation and an increased internal hardness (due to the increased hardness of the ferrite base metal) and poor toughness. Also, cracks occurred during the head toughness test.

No. 17 is a comparison bolt consisting of a steel whose Mn content and DI value are higher than the ranges disclosed in the present invention. The hardenability of this bolt was too high and the hardened layer was too deep, resulting in an increase of both surface and internal hardness and to poor toughness. The head was broken in the head toughness test.

No. 18 is a comparison bolt consisting of a steel whose Mn content and DI value are lower than the ranges disclosed in the present invention. Although good results were obtained in the head toughness test, the desired strength could not be obtained and the bolt had a poor tapping ability (similar to bolt No. 15).

No. 19 is a comparison bolt consisting of a steel whose P content is higher than the ranges disclosed in the present invention. Cracks occurred in the head toughness test due to a reduction in the strength of the grain boundaries.

No. 20 is a comparison bolt consisting of a steel whose S content is higher than the ranges disclosed in the present invention, and whose DI value is lower than the ranges disclosed in the present invention. Cracks occurred in the head toughness test due to the adverse effects of the formation of MnS.

No. 21 is a comparison bolt consisting of a steel whose Al content is lower than the ranges disclosed in the present invention. This bolt was over-hardened due to the formation of coarse crystal grains and the internal toughness of the bolt was therefore insufficient. As a result, the head was broken in the head toughness test.

No. 22 is a comparison bolt consisting of a steel whose N content is higher than the ranges disclosed in the present invention. The internal toughness of the bolt was insufficient and cracks occurred in the head toughness test.

No. 23 is a comparison bolt consisting of a steel whose B content is higher than the ranges disclosed in the present invention. Cementite containing boron was deposited on the grain boundaries resulting in a lowering of the strength of the boundaries, also cracks occurred in the head toughness test. The Ti content is also higher than the ranges disclosed in the present invention. Large quantities of hard TiC and TiN were present which adversely affected the cold forgeability and the toughness.

No. 24 is a comparison bolt consisting of a steel whose Nb content and the DI value are higher than the ranges disclosed in the present invention. Due to the presence of large quantities of intermetallic compounds such as NbC and Nb(CN), the grain boundary strength was lowered and cracks occurred in the head toughness test.

No. 25 is a comparison bolt consisting of a steel whose Cr content and DI value are higher than the ranges disclosed in the present invention and No. 27 is a comparison bolt consisting of a steel whose Mo content is higher than the ranges disclosed in the present invention. In both bolts cracks occurred in the head toughness test (and heads were broken) due to a lack of sufficient toughness.

No. 26 is a comparison bolt consisting of a steel whose Cr content and DI value are lower than the ranges disclosed in the present invention. In this bolt the hardenability was lowered and the desired strength could not be obtained. Cracks occurred in the head toughness test.

No. 28 is a comparison bolt consisting of a steel whose tempering temperature was lower than the range disclosed in the present invention. In this bolt (due to a lack of sufficient toughness), the head wad broken in the head toughness test.

No. 29 is a comparison bolt consisting of a steel whose tempering temperature was higher than the range disclosed in the present invention. The tapping ability of this bolt was poor due to the bolt attaining insufficient strength.

No. 30 is a comparison bolt consisting of a steel whose effective depth of the effective hardened layer is shallower than the ranges disclosed in the present invention. The tapping ability of this bolt was poor due to a lack of sufficient strength.

As described above, the present invention has provided a steel suitable for the manufacture of high-strength screws and a high-strength screw, that have an excellent tapping ability. i.e. the ease of forming internal threads and internal toughness as well as having the desired bolt strength.

What is claimed is:

1. A high-strength screw made of the steel comprising (by % mass):

C: 0.05 to 0.20,

Si: 0.20 or less (not including 0),

Mn: 0.5 to 2.0,

P: 0.015 or less,

S: 0.015 or less, sol. Al: 0.020 to 0.080,

N: 0.0060 or less,

Cr: more than 0.80 to 2.0, with the balance of the mass being iron and unavoidable impurities wherein said steel has been hardened by cementation and tempering to form a surface hardness Hv of 550 to 700, an internal hardness Hv after cementation of 200 to 320, and the effective depth of the hardened layer is 0.05 to 1.00 mm, and the strength of 800 N/mm$^2$ or more.

2. A high-strength screw made of the steel according to claim 1, wherein the steel further comprises (by % mass):

at least one selected from the group consisting of:

Ni: 3.5 or less,

Cu: 1.0 or less,

Mo: 0.30 or less,

B: 0.0005 to 0.0050; and at least one selected from a group consisting of:

Ti: 0.005 to 0.050, and

Nb: 0.005 to 0.050.

3. A high-strength screw made of the steel according to claim 1, wherein the DI value represented by the following equation (1) is within a range between 17 mm and 43 mm:

$$DI=25.4\times DIC(*1)\times FSi(*2)\times FMn(*3)\times FCr(*4)\times(FMo(*5), FCu(*6), FNi(*7), FB(*8)),$$

where:

*1: DIC=0.54×(C),

*2: FSi=1.00+0.7×(Si),

*3: FMn=3.3333 (Mn)+1.00(Mn≦1.20), FMn=5.10×(Mn)−1.12(Mn>1.20),

*4: FCr=1.00+2.16×(Cr),

*5: FMo=1.00+3.00×(Mo),

*6: FCu=1.00+0.365×(Cu),

*7: FNi=1.00+0.363×(Ni), and

*8: FB=2 (only when B is added).

4. A high-strength screw made of the steel according to claim 2, wherein the DI value represented by the following equation (1) is within a range between 17 mm and 43 mm:

$$DI=25.4\times DIC(*1)\times FSi(*2)\times FMn(*3)\times FCr(*4)\times(FMo(*5), FCu(*6), FNi(*7), FB(*8)),$$

where:

*1: DIC=0.54×(C),

*2: FSi=1.00+0.7×(Si),

*3: FMn=3.3333×(Mn)+1.00(Mn≦1.20), FMn=5.10×(Mn)−1.12(Mn>1.20),

*4: FCr=1.00+2.16×(Cr),

*5: FMo=1.00+3.00×(Mo),

*6: FCu=1.00+0.365×(Cu),

*7: FNi=1.00+0.363×(Ni), and

*8: FB=2 (only when B is added).

5. A high-strength screw according to claim 3, wherein tempering is carried out within a temperature range of between 200° C. and 400° C. after cementation.

6. The high-strength screw according to claim 4, wherein tempering is carried out within a temperature range of between 200° C. and 400° C. after cementation.

* * * * *